US005093996A

United States Patent [19]

Gross

[11] Patent Number: 5,093,996

[45] Date of Patent: Mar. 10, 1992

[54] ERGONOMIC SCISSORS

[75] Inventor: Clifford M. Gross, Roslyn, N.Y.

[73] Assignee: Biomechanics Corporation of America, Deer Park, N.Y.

[21] Appl. No.: 533,465

[22] Filed: Jun. 5, 1990

[51] Int. Cl.[5] ..... B26B 13/02; B26B 13/16; B26B 13/18; B26B 13/20

[52] U.S. Cl. ..... 30/245; 30/250; 30/253; 30/261

[58] Field of Search ..... 30/245, 250, 252, 253, 30/257, 261, 256

[56] References Cited

U.S. PATENT DOCUMENTS

| | | | |
|---|---|---|---|
| D. 263,350 | 3/1982 | Gingher, Jr. . | |
| 415,216 | 11/1889 | McDonough | 30/253 |
| 654,008 | 7/1900 | Kirkland | 30/253 |
| 770,347 | 9/1904 | Brown | 30/253 |
| 1,186,235 | 6/1916 | Schrade . | |
| 1,299,104 | 4/1919 | Arnold | 30/253 |
| 2,142,738 | 1/1939 | Wakeley . | |
| 2,597,519 | 5/1952 | O'Brien . | |
| 2,852,846 | 9/1958 | Ahlbin . | |
| 3,015,160 | 1/1962 | Fogle | 30/253 |
| 3,548,496 | 12/1970 | Van Hook . | |
| 4,092,776 | 6/1978 | Ferguson | 30/253 |

FOREIGN PATENT DOCUMENTS

| | | | |
|---|---|---|---|
| 930151 | 7/1973 | Canada | 30/253 |

*Primary Examiner*—Douglas D. Watts
*Assistant Examiner*—Paul M. Heyrana
*Attorney, Agent, or Firm*—Marmorek, Guttman & Rubenstein

[57] ABSTRACT

A scissors which may be utilized by persons having weakened hand muscles is disclosed. The scissors comprises first and second blade elements. Each of the blade elements includes a front portion having a sharp cutting edge, a middle portion and a rear portion. The blade elements are pivotally mounted at the rear portions thereof and biased by a spring member towards the open position of the scissors. First and second handles are attached to the middle portions of the first and second blade elements, respectively. The handles increase the effective widths of the middle portions of the blade elements thereby increasing the mechanical advantage of the scissors. This permits a user of the scissors to close the scissors with a smaller force.

9 Claims, 2 Drawing Sheets

ERGONOMIC SCISSORS

FIELD OF THE INVENTION

The present invention relates to scissors which can be used by persons who are unable to use conventional scissors because of a peripheral neuropathy or other pathology which causes a weakness in the user's hand muscles.

BACKGROUND OF THE INVENTION

Persons with a peripheral neuropathy or other hand pathology such as arthritis often find conventional scissors difficult to use. One reason is that conventional scissors require the exertion of relatively large forces which is difficult for persons having arthritis or some type of peripheral neuropathy resulting in weak hand muscles. In addition, some of the conventional scissors incorporate looped finger grips which are difficult or cumbersome for persons with arthritis or peripheral neuropathies to utilize. Examples of such conventional scissors are disclosed in Ahlbin, U.S. Pat. No. 2,852,846; Van Hook, U.S. Pat. No. 3,548,496; Schrade, U.S. Pat. No. 1,186,235; O'Brien, U.S. Pat. No. 2,597,519; Wakely, U.S. Pat. No. 2,142,738 and Gingher, Jr., DES 263,350.

Accordingly, it is an object of the present invention to provide scissors suitable for use by persons with weak hand muscles and/or reduced neurological control. More particularly, it is an object of the present invention to provide scissors having an increased mechanical advantage so that the scissors may be utilized by exerting reduced forces.

SUMMARY OF THE INVENTION

The present invention is directed to scissors which are suitable for use by persons with weak hand muscles. The scissors comprise two blade elements. Each blade element comprises a front portion including a sharp cutting edge, a rear portion and a middle portion. The blade elements are pivotably mounted at the rear portions thereof so that the front cutting portions of the blade elements can rotate towards each other into a closed position to cut a material such as paper or cloth, etc. The front cutting portions of the blade elements then rotate away from each other to bring the scissors into an open position. Also coupled to the rear portion of the blade elements is a spring member. The spring member exerts a bias which forces the scissors from the closed position back into the open position and which maintains the scissors in the open position unless a force is exerted on the blade elements by the user.

A handle is coupled to the middle portion of each blade element. Each handle incorporates a flat surface which is engaged by a user of the scissors. Illustratively, one handle is engaged by the thumb and the other handle is engaged by the index finger of a hand of the user, so that the scissors is taken between the thumb and index finger of the user. Forces are exerted on the two handles by the thumb and index finger to bring the scissors into the closed cutting position.

It is a significant feature of the inventive scissors that the handles which are coupled to the middle portion of the blade elements increase the effective width of the middle portion of the blade elements. The increased widths provided by the handles increases the mechanical advantage of the scissors so that the user can exert smaller forces to close the scissors than would be the case if the handles were absent or had the same width as the middle portions of the blade elements.

For this reason the inventive scissors is especially useful for people with weak hand muscles resulting from arthritis or some type of peripheral neuropathy.

BRIEF DESCRIPTION OF THE DRAWING

Like elements in the Figures have the same identifying numerals.

DETAILED DESCRIPTION OF THE INVENTION

Figure 1:
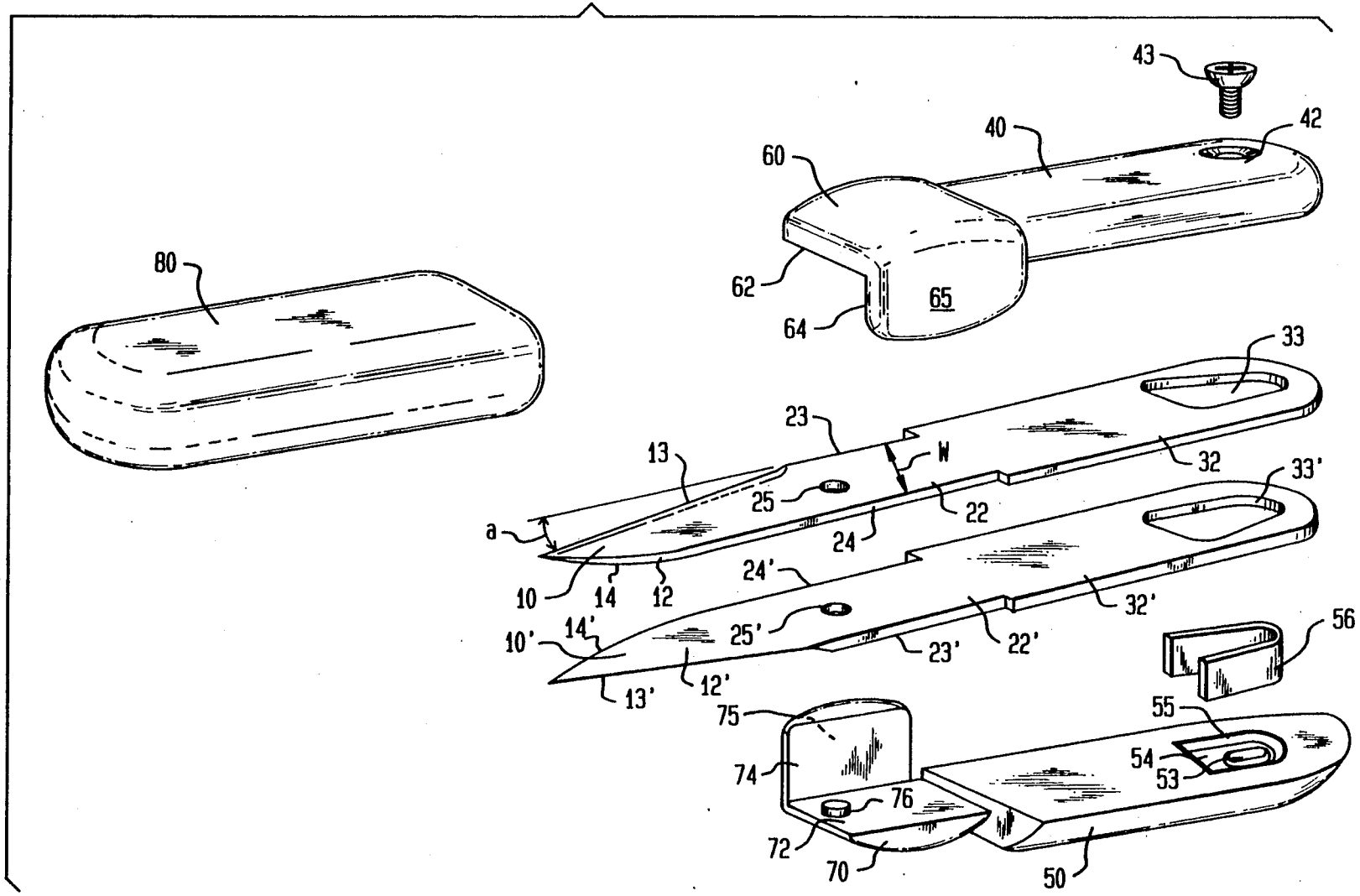
FIG. 1 is an exploded view of scissors for use by persons with a peripheral neuropathy in accordance with an illustrative embodiment of the invention.

The elements utilized to form the inventive scissors are shown in FIG. 1.

The inventive scissors comprises two identical blade elements 10 and 10'. The blade element 10 comprises a front portion 12, a middle portion 22 and a rear portion 32. Similarly, the blade element 10' includes a front portion 12', a middle portion 22' and a rear portion 32'. Illustratively, the blade elements 10 and 10' are formed from stamped stainless steel and have a thickness of about 0.04 inches.

The front portions 12 and 12' of the blade elements 10 and 10' are bounded in part by the sharp cutting edges 13 and 13', respectively. The edges 13 and 13' are oriented at an angle a which illustratively is equal to 7.5 degrees. The front portions 12 and 12' of the blade elements 10 and 10' are also bounded in part by the curved edges 14 and 14' respectively, which curved edges have a radius of about 0.84 inches. The length of the front portions 12 and 12' of the blade elements 10 and 10' is about 1.6 inches.

The middle portions 22 and 22' of the blade elements 10 and 10' are bounded by the straight spaced apart edges 23, 24, and 23', 24', respectively. The width w of the middle portions 22 and 22' is about 0.45 inches and the length is about 0.95 inches. The middle portions 22 and 22' of the blade elements 10 and 10' include the openings 25 and 25' whose purpose is discussed below.

The rear portions 32 and 32' of the blade element 10 and 10' have a length of about 1.8 inches and a width of about 0.63 inches. Each of the blade members 10 and 10' also includes at its rear portions an elongated opening 33 and 33' whose purpose is discussed below.

The inventive scissors also incudes two housing members 40 and 50. When the scissors is assembled, the housing member 40 covers the rear portion 32 of the blade element 10 and the housing member 50 covers the rear portion 32 of the blade element 10'. The housing member 50 includes a recess 54 for retaining a U-shaped steel spring 56. In particular, the U-shaped spring 56 is retained in the recess 54 by the lip 55. A similar recess is incorporated in the housing member 40.

The housing member 40 includes an opening 42 for receiving the screw 43. The housing member 50 also includes an opening 53 for the screw 43.

To assemble the inventive scissors, the blade elements 10 and 10' are oriented as shown in FIG. 1 with their cutting edges 13 and 13' facing towards each other. The blade elements are positioned between the housing members 40 and 50, such that the U-shaped spring 56 sits in the recess 54 of the hosing member 50 and also extends through the openings 33' and 33 of the blade elements 10 and 10' to a corresponding recess in the housing member 40. The screw 43 extends through the opening 42 in the housing member 40, through the openings 33 and 33' in the blade elements 10 and 10' and into the opening 53 in the housing member 40. Thus, when the scissors is assembled, the U-shaped spring 56 surrounds the screw 43 in the openings 33 and 33' of the blade elements.

In this manner, the blade elements 10 and 10' are pivotally mounted at the rear portions 32 and 32' thereof. To bring the scissors to a closed position to cut material such as paper, the blade elements 10 and 10' pivot toward each other about the screw 43 into a closed position. To bring the scissors to an open position, the blade elements pivot away from each other about the screw 43. The U-shaped spring 56 biases the blade elements so that the scissors is normally in the open position. Thus, the user needs to exert a force to close the scissors but the spring 56 serves to return the scissors to an open position.

A significant feature of the inventive scissors is the handles 60 and 70 which are formed integrally with the housing elements 40 and 50. Each handle 60,70 includes a side portion 62,72 which is connected to the corresponding housing member 40,50 and a surface portion 64,74.

As shown in connection with the handle 70, a post 76 is formed integrally with the side portion 72. The post 76 fits into the opening 25' of the middle portion 22' of the blade element 10' to attach the handle 70 to the blade element 10'. In an identical fashion, the handle 60 is attached to the middle portion 22 of the blade element 10. Note that the surface portion 64 of the handle 60 includes the surface 65 for contacting one finger of the user and the surface portion 74 of the handle 70 includes a similar surface 75 for contacting another finger of the user.

Figure 2:
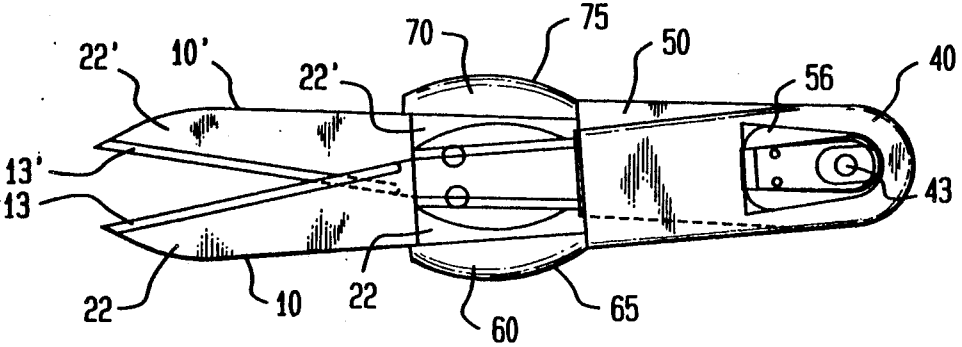
FIG. 2 shows the inventive scissors in an open position.
Figure 3:
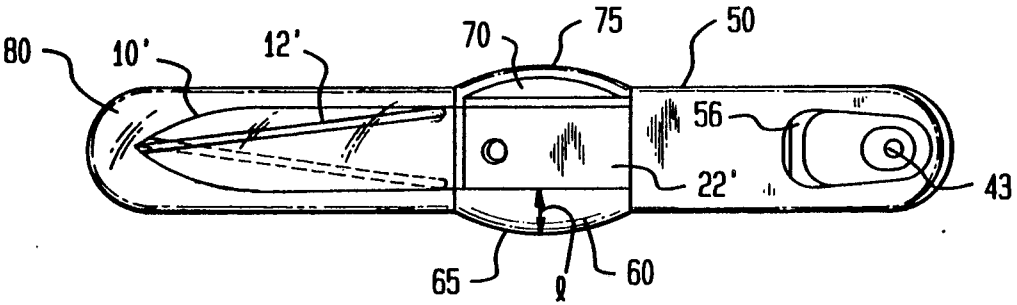
FIG. 3 shows the inventive scissors in a closed position.

FIG. 2 and FIG. 3 show the inventive scissors after assembly. FIG. 2 shows the inventive scissors in the open position and FIG. 3 shows the inventive scissors in the closed position.

As shown in FIG. 2, when the scissors is assembled as described earlier so that the blade elements pivot about the screw 43 and are biased by the spring 56, the contacting surface 75 of one handle 70 is on top of the scissors and the contacting surface 65 of the other handle 60 is on the bottom of the scissors. To use the scissors, the user takes the handles 70 and 60 between the thumb and the forefinger so that the thumb contacts the surface 75 and the forefinger contacts the surface 65. Since the scissors is biased by the spring 56 into the open position as shown in FIG. 2, the user exerts a force to close the scissors. The spring then brings the scissors back into the open position. This type of biasing arrangement is advantageous in that it requires the use of protagonist rather than antagonist muscles on the part of the user.

Illustratively, the housing members 40 and 50 and the corresponding handles 60 and 70 are made of a viscoelastic material such as santoprene. Since the skin is also a viscoelastic material, there is good compliance matching between the skin and the contact surfaces of the handles. Illustratively, the lengths of the handles 60 and 70 are coextensive with the middle portions 22 and 22' of the corresponding blade elements 10 and 10'. The lengths of the housing members 40 and 50 are coextensive with the rear portions 32 and 32' of the corresponding blade elements 22 and 22'.

The handles 60 and 70 serve to increase the effective width of the middle portions of the blade elements. This increases the mechanical advantage of the scissors and therefore allows the scissors to be closed using reduced forces. This makes the inventive scissors especially useful for persons having weak hand muscles. Illustratively, use of the handles adds an amount l (see FIG. 2) to the effective width of the middle portion of each blade element. Illustratively, l is about 0.25 inches.

As shown in FIG. 1 and FIG. 3, a cap 80 is used to cover the front cutting portion of the blade elements when the scissors is not in use. As shown in FIG. 3, the cap 80 maintains the scissors in the closed position.

Finally, the above-identified embodiments of the invention are intended to be illustrative only. Numerous alternative embodiments may be devised by those skilled in the art without departing from the spirit and scope of the following claims.

I claim:

1. A scissors comprising first and second blade elements, each of said blade elements including a front portion having a cutting edge, a middle portion, and a rear portion, mounting means for pivotally mounting said first and second blade elements at the rear portions thereof, so that said blade elements can pivot between an open position and a closed cutting position, said mounting means including a spring member for biasing said blade elements towards the open position, and first and second handles associated with the middle portion of said first and second blade elements, respectively, said handles being dimensioned so as to extend outwardly from said blade elements in a plane which contains said blade elements thereby serving to increase the effective width in said plane of said blade elements at the middle portions thereof and providing contacting surfaces for contacting by the fingers of a user of the scissors.

2. The scissors of claim 1 wherein said scissors comprises first and second housing members covering said rear portions of said first and second blade elements respectively.

3. The scissors of claim 2 wherein said first and second handles are formed integrally with said first and second housing members, respectively.

4. The scissors of claim 1 wherein said spring member comprises a U-shaped stainless steel spring.

5. The scissors of claim 1 wherein said handles are formed from a viscoelastic material.

6. The scissors of claim 1 wherein said handles are curved outwardly from said blade elements in a plane which contains said blade elements.

7. A scissors comprising first and second blade elements, each of said blade elements including a front portion having a cutting edge, a middle portion and a rear portion, mounting means for pivotally mounting said blade elements at the rear portions thereof, said mounting means including a biasing means for biasing said scissors in an open position, and first and second handles attached to the middle portion of said first and second blade elements, respectively, said handles being dimensioned so as to extend outwardly from said blade elements in a plane which contains said blade elements for increasing the effective width of the middle portions of said blade elements in said plane to increase the mechanical advantage of said scissors thereby reducing the force required to close said scissors, whereby said scissors is usable by persons having weakened hand muscles.

8. The scissors of claim 7 wherein said handles are curved outwardly from said blade elements in a plane which contains said blade elements.

9. The scissors of claim 7 further comprising first and second housing members covering said rear portions of said first and second blade elements respectively, and wherein said first and second handles are formed integrally with said first and second housing members, respectively.

* * * * *